US007325383B2

(12) United States Patent
Matsunaga et al.

(10) Patent No.: US 7,325,383 B2
(45) Date of Patent: Feb. 5, 2008

(54) BAG MAKING AND FILLING METHOD USING DOUBLE FILM

(75) Inventors: Shinji Matsunaga, Fukuoka (JP); Orihiro Tsuruta, Gunma (JP)

(73) Assignee: Orihiro Co., Ltd., Gunma (JP)

( * ) Notice: Subject to any disclaimer, the term of this patent is extended or adjusted under 35 U.S.C. 154(b) by 5 days.

(21) Appl. No.: 10/514,087

(22) PCT Filed: May 14, 2003

(86) PCT No.: PCT/JP03/06005

§ 371 (c)(1),
(2), (4) Date: Nov. 10, 2004

(87) PCT Pub. No.: WO03/097461

PCT Pub. Date: Nov. 27, 2003

(65) Prior Publication Data

US 2005/0172576 A1 Aug. 11, 2005

(30) Foreign Application Priority Data

May 15, 2002 (JP) ..... 2002-139663

(51) Int. Cl.
*B65B 9/00* (2006.01)
*B65B 11/58* (2006.01)

(52) U.S. Cl. ..... 53/451; 53/449; 53/450; 53/133.2

(58) Field of Classification Search ..... 53/450, 53/451, 133.2, 545, 550, 551, 552, 449, 373.2; 156/244.13, 244.14; 383/109
See application file for complete search history.

(56) References Cited

U.S. PATENT DOCUMENTS

| | | | | |
|---|---|---|---|---|
| 3,130,647 | A * | 4/1964 | Anderson et al. | 383/109 |
| 3,190,441 | A * | 6/1965 | Rausing | 383/109 |
| 3,670,954 | A * | 6/1972 | Leventhal | 383/109 |
| 4,358,330 | A * | 11/1982 | Aronovici | 156/244.14 |
| 4,578,051 | A * | 3/1986 | Everman | 493/8 |
| 4,695,337 | A * | 9/1987 | Christine | 53/133.2 |
| 4,709,528 | A * | 12/1987 | Merkus | 53/133.2 |
| 4,710,157 | A * | 12/1987 | Posey | 53/133.2 |
| 4,851,272 | A * | 7/1989 | Knox et al. | 428/35.2 |
| 5,134,001 | A * | 7/1992 | Osgood | 428/35.2 |
| 5,350,471 | A * | 9/1994 | Planeta | 156/244.14 |
| 5,467,581 | A * | 11/1995 | Everette | 53/133.2 |
| 6,178,725 | B1 * | 1/2001 | Sperry et al. | 53/551 |
| 6,371,646 | B1 * | 4/2002 | LaFleur | 383/109 |

(Continued)

FOREIGN PATENT DOCUMENTS

| | | |
|---|---|---|
| JP | 49-47557 | 12/1974 |

(Continued)

*Primary Examiner*—Louis Huynh
(74) *Attorney, Agent, or Firm*—Knobbe Martens Olson & Bear, LLP

(57) ABSTRACT

A tubular film is flattened to form a continuous two-ply film in which the two side edges are continuously connected in the longitudinal direction. This two-ply film is curved into a tubular form, the two side edges are overlapped, and a vertical seal portion is formed in the overlapping portion to form a tube body, and the tube body is filled with a product. The tube body that has been filled with product is horizontally sealed, and the horizontal seal portion that has been thus formed is cut to produce a two-ply bag package.

14 Claims, 6 Drawing Sheets

U.S. PATENT DOCUMENTS 6,582,123 B1 * 6/2003 Tang ..... 383/100
6,652,984 B2 * 11/2003 Finestone et al. ..... 428/480
6,826,892 B2 * 12/2004 Basque et al. ..... 53/551

FOREIGN PATENT DOCUMENTS

JP 07-165209 6/1995
JP 08-117317 5/1996
JP 08-310296 11/1996
JP 09-020311 1/1997
JP 10-211901 8/1998
JP 11-070907 3/1999
JP 2000-185743 7/2000
JP 2000-1904402 7/2000

* cited by examiner

BAG MAKING AND FILLING METHOD USING DOUBLE FILM

This application is the U.S. National Phase under 35 U.S.C. § 371 of International Application PCT/JP03/06005, filed Nov. 27, 2003, which claims priority to Japanese Patent Application No. 2002-139663, filed May 15, 2002. The International Application was not published under PCT Article 21(2) in English.

BACKGROUND OF THE INVENTION

1. Field of the Invention

The present invention relates to a bag forming, filling, and sealing method that employs a two-ply film, whereby bags are produced from two-ply film in which an internal film and an external film are superposed and filled with product.

2. Description of the Related Art

The use of a two-ply film, in which an internal film and external film are superposed and in which the internal film and external film are sealed in portions (partially sealed) to prevent the occurrence of shifting between the two layers, as a film for use in packaging is known in the art (refer to Japanese Patent Laid-Open Publication No. 20311/97). In such a case, a two-ply bag package material can be fabricated by curving two-ply film into a tubular form and then forming both a vertical seal in the two overlapping edges and an upper horizontal seal and a lower horizontal seal in a direction that intersects the vertical seal portion.

Various techniques for fabricating a package body have been disclosed in a variety of publications in the prior art. For example, bags for "bag-in-box" packaging are disclosed in Japanese Patent Laid-Open Publication No. 2000-185743 and Japanese Patent Laid-Open Publication No. 310296/96. A bag forming, filling, and sealing method that employs film in band form is disclosed in Japanese Patent No. 2553819. Further, bag packages in which a spout is attached on the side surface is described in Japanese Patent Laid-Open Publication No. 2000-190402, and a bag forming, filling, and sealing method that is provided with a cap on the end surface is described in Japanese Patent No. 2775396.

However, the above-described bag forming, filling, and sealing techniques that employ two-ply film have the following problems:

The first problem is the inability to completely eliminate shifting between the two layers of film that occurs in the process of fabricating a two-ply bag package stock. This problem is next described using an example of vertical bag forming, filling, and sealing in which the film moves in a vertical direction.

A two-ply film that has been formed in tubular form by forming a vertical seal portion is caused to move downward by feed rollers on the downstream side. The feed rollers simultaneously grasp the left side and the right side of the cylindrical film between respective pairs of rollers so as to pinch the cylindrical film from the outside on both sides in the horizontal direction. In this case, the outer side of the film is grasped and the inner side of the film does not directly contact the rollers. There is consequently a concern that when rollers are positioned at points that have not undergone partial sealing, the internal film will slip and its relative position consequently shift. This slight shift is held until the position of the next partial seal portion, and if horizontal sealing is carried out in this state, the bag will be sealed with the external film kinked and wrinkled at the horizontally sealed portion. Not only will a seal of this nature naturally be a defective seal, but this type of shift in the film may also result in excessive load on the feed rollers, causing activation of the automatic safety devices and a halt of operation of the packaging machine.

As a second problem, a seal processing step is required in the prior art in which film is paid out from two rolls of stock, superposed, and then sealed to form the two-ply film. This necessity complicates processing and results in higher fabrication costs.

As a third problem, when fabricating packaging stock using two-ply film that is superposed by means of partial seal portions, the occurrence of these partial seal portion in noticeable positions of the packaging material detracts from the appearance of the material. As a solution, the positions where partial seal portions are provided may be vertically or horizontally sealed to conceal the partial seal portions. However, implementing control for aligning the vertical sealing or horizontal sealing with the partial seal portions is complex, and further, discrepancies in the drive timing for vertical seals may result in defective seals.

SUMMARY OF THE INVENTION

The present invention was realized in view of the above-described problems of the prior art. It is therefore an object of the present invention to provide a bag forming, filling, and sealing method that can suppress the occurrence of shifting between an internal film and an external film when filling and fabricating bags and thus suppress the occurrence of defects in seal portions and defects in appearance.

To achieve the above-described object, the bag forming, filling, and sealing method that employs two-ply film according to the present invention is a method in which two-ply film is intermittently paid out for each step of introducing product and in which a two-ply bag package body is fabricated and filled with a product by means of a pillow-type packaging machine, the bag forming, filling, and sealing method including the following steps:

First, a two-ply film is prepared by flattening a tubular film such that both side edges are continuously connected in the longitudinal direction. The two-ply film that has been prepared in the step of preparing the two-ply film is then curved into tubular form, and a vertical seal portion is formed along the two overlapping side edge to form a continuous tube body. The tube body, in which a horizontal seal portion in formed in the bottom portion in a previous step, is filled with a product, following which the portion above the introduced product is sealed to form the horizontal seal portion for this step. The horizontal seal portion that has been formed in this way is divided between an upper horizontal seal portion and a lower horizontal seal portion, and the leading lower two-ply bag package then extracted.

Film that has been formed in tube form by inflation forming (inflation tube) may be employed as the tubular film.

Bag forming, filling, and sealing using two-ply film is realized with each repetition of the steps from the step for forming the tubular body up to the step of extracting the two-ply bag package as described above.

In addition, the bag forming, filling, and sealing method using a two-ply film according to the present invention further includes, in the step of forming a continuous tube body, a step of punching a hole for installing a spout in the tube body and installing a spout.

The bag forming, filling, and sealing method that employs a two-ply film according to the present invention may include, in the step of curving the two-ply film into tubular form and forming a vertical seal portion in the two overlapping side edges to form a continuous tube body, a step of clasping a spout between the two side edges.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Explanation first regards a two-ply bag package that is obtained by an embodiment of the bag forming, filling, and sealing method using a two-ply film according to the present invention.

Figure 1:
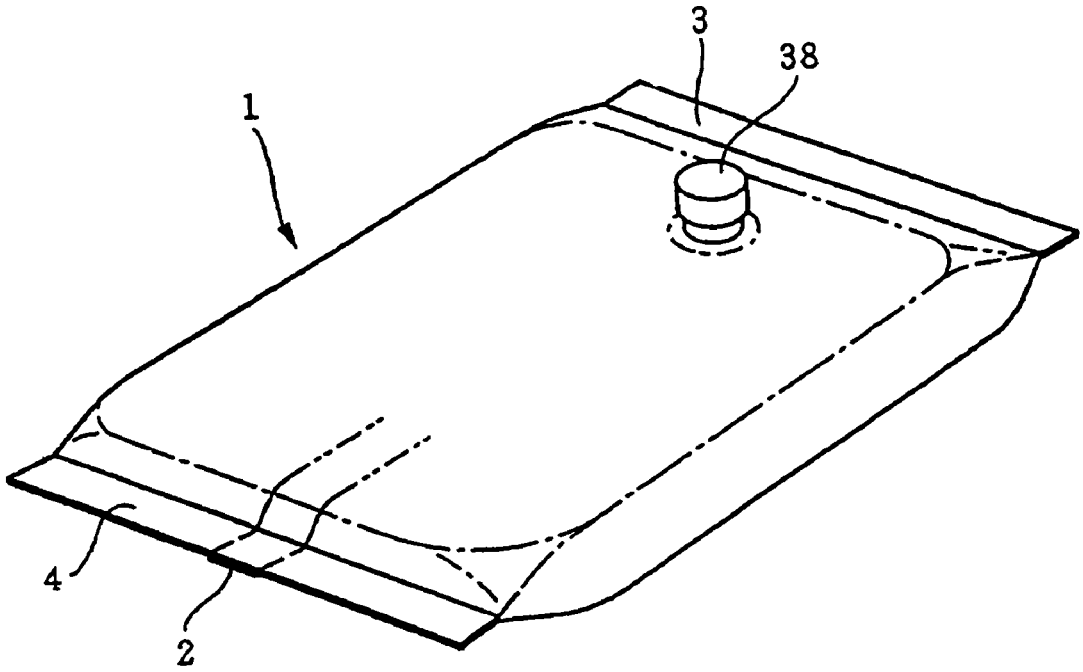
FIG. 1 is an overall perspective view as seen from the front of a two-ply bag package that employs two-ply film according to an embodiment of the present invention.
Figure 2:
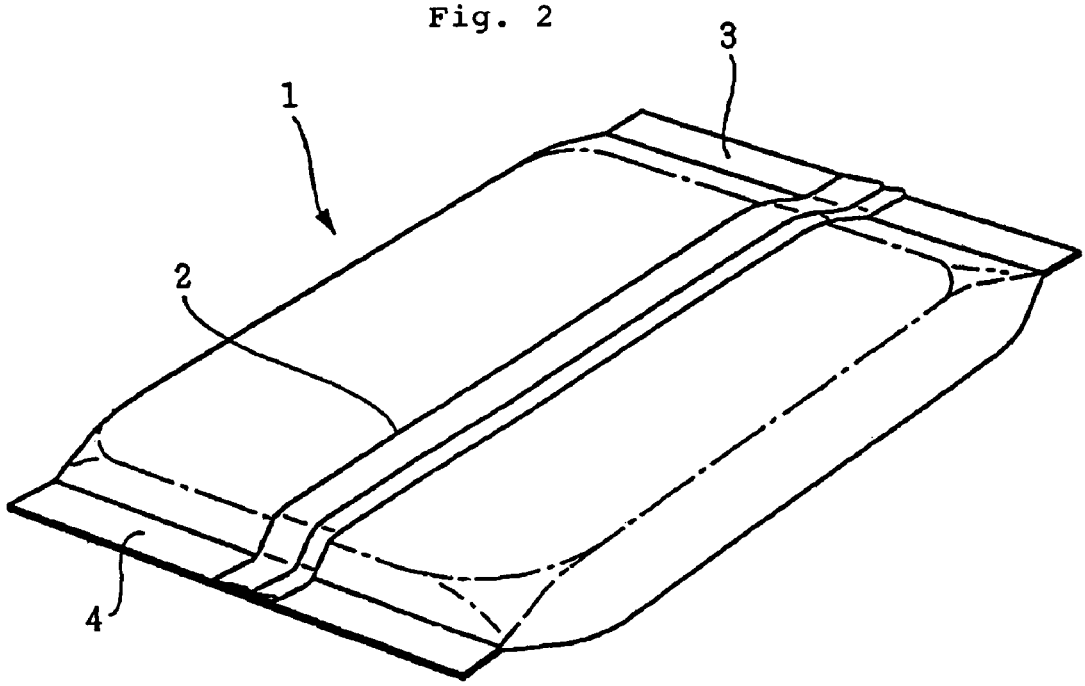
FIG. 2 is an overall perspective view as seen from the rear of a two-ply bag package that employs two-ply film according to an embodiment of the present invention.

FIG. 1 and FIG. 2 show a two-ply bag package that is obtained by means of an embodiment of the present invention, FIG. 1 being a perspective view as seen from the front of the package, and FIG. 2 being a perspective view as seen from the rear of the package.

Figure 6:
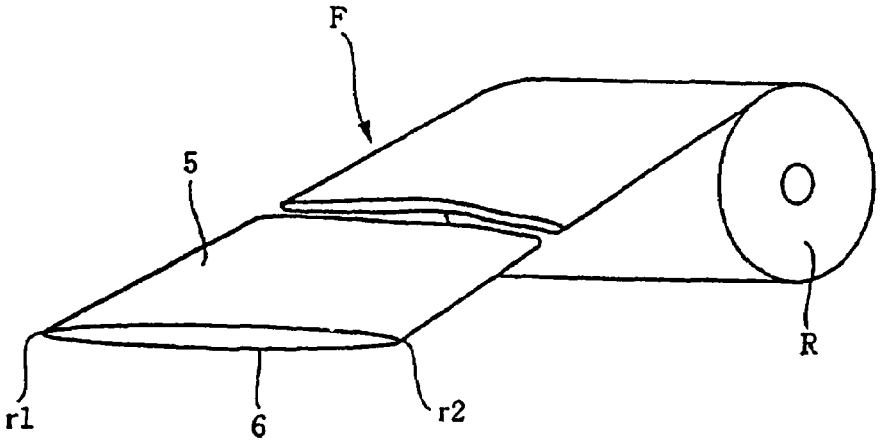
FIG. 6 is a perspective view showing the form of the two-ply film according to the present invention.

Two-ply bag package 1 is formed from two-ply film F (See FIG. 6). To state in more detail, two-ply bag package 1 is obtained by curving two-ply film F into a tubular form and then forming both a vertical seal portion 2 in the two overlapping side edges and upper horizontal seal portion 3 and lower horizontal seal portion 4 in a direction that intersects vertical seal portion 2. A product is introduced inside two-ply bag package 1.

Two-ply film F of the present embodiment is a tubular film that has been flattened as shown in FIG. 6. In this case, the area that is the inner side of two-ply film F when the two-ply film F is in the wound state of rolled stock R is internal film 6, and the area that is the outer side is external film 5.

Obviously, the two side edges r1 and r2 are continuously connected in the longitudinal direction of two-ply film F, and external film 5 and internal film 6 are of the same material. In addition, the film that makes up two-ply film F may be composed either of a single-layer film or a laminated film.

Two-ply bag package 1, in addition to being used by itself, is also used as the inner bag of a bag-in-box.

As example of the use of two-ply bag package 1 by itself is a large bag that accommodates a product weighing 2-20 kg for packaging liquid foods such as a sauce, ketchup, or juice. Two-ply bag package 1 has excellent resistance to pin-holing, and is therefore ideal as a large commercial package that is used in particular for storing or distributing products in a frozen or refrigerated state.

A bag-in-box is an article in the form of a container in which an inner bag and outer package are combined. A bag-in-box may use an inner bag in which two or more layers of film are laminated and heat-sealed in bag form to accommodate a liquid, and may use as the outer package a plastic container or cardboard box having sufficient rigidity to maintain its shape during shipping or storing.

Such containers are widely used in the field of liquid foodstuffs such as, in particular, juice, mineral water, soft drinks, coffee, condiments, vegetable oil, sauce, and ketchup.

Inflation film is preferable as the tubular film that is employed. Inflation film is in tube form beforehand and can be used in its manufactured state without alteration. In other words, there is no need to form a two-ply film in tubular form by partially sealing two layers of film, and the inflation film is also free of seams. In addition, inflation film can be easily manufactured as a thick film in thicknesses ranging from 60 μm to 150 μm.

As described hereinabove, inflation film is most suitable as the tubular film that is employed. However, the present invention is not limited to inflation film and allows the use of a material in which two layers of film in band form are welded together on both edges in the longitudinal direction, or a material in which one layer of film in band form is curved into tubular form and the overlapping side edges then welded together to form a tubular form. When the two-ply film is formed from two layers of film in band form, one may be composed of a single layer of film, and the other may be composed of laminated film.

As in the prior art, when the internal film and external film are bonded by partial seal portions, the partial seal portions are provided in a row in the longitudinal direction of the two-ply film and separated by prescribed spaces. However, in a two-ply film as described above, the joined portions of the two layers of film (for example, side edges r1 and r2 in FIG. 6) are continuously connected in the longitudinal direction of the two-ply film. As a result, the occurrence of shifting between the two layers of film is impeded.

A preferable laminated structure of inflation film is as follows:

For single-layer film:

simple LDPE
simple HDPE
simple PP

For multiple layers (indicating the layer composition from the outside toward the inside):

LDPE/LDPE
HDPE/LDPE
MDPE/LDPE
PP/LDPE
LDPE/HDPE/LDPE
LDPE/PA/LDPE
LDPE/MDPE/LDPE
LDPE/LDPE/LDPE
LDPE/EVOH/LDPE

Explanation of Abbreviations:

HDPE: High-Density Polyethylene

MDPE: Medium-Density Polyethylene

PP: Polypropylene

PA: Polyamide

EVOH: Ethylene Vinyl Alcohol Copolymer

The resin that makes up the innermost layer is an LDPE having excellent heat-sealing characteristics; and of LDPE, preferably a LLDPE (Linear Low-Density Polyethylene) that features toughness and strength, and more preferably a VLDPE (a linear Very Low Density Polyethylene) that is fabricated by means of a single-site (metallocene) catalyst and having excellent resistance to exudation and low poly odor.

LLDPE that is fabricated by means of multi-site catalysts such as magnesium compounds or titanium-based catalysts has excellent film processing characteristics. However, this type of LLDPE has a wide molecular-weight distribution and therefore contains low-molecular region components, and these components can give rise to poly odors. These low-molecular region components have an effect on the flavor or odor of a product that contacts the film. In addition, the migration (exudation) of low-molecular substances may also give rise to problems relating to sanitation. In contrast, VLDPE that is produced by means of single-site catalysts has a narrow molecular-weight distribution, has few low-molecular region components, and therefore can limit the migration of poly odors.

Two-ply bags are preferably composed of unoriented (unstretched) film that is fabricated by means of an inflation method, as explained hereinbelow.

In the case of three-sided seal packaging having a back seal portion, four layers of film typically overlap at the intersection of the back seal portion and the end seal portion. The inadequacy of pressure-welding in such overlapped portions tends to result in the occurrence of fine, tunnel-like unsealed portions. In particular, when a two-ply film is fabricated using a laminated film that includes a rigid film such as biaxially oriented polyamide, not only does the rigid stretched film impede welding, but eight layers of film now overlap at the intersection of the back seal portion and end seal portion, and fine, tunnel-like unsealed portions are even more likely to occur.

In the present embodiment, however, the film is formed from an unoriented film of polyethylene (including LD, LLDPE, VLDPE, HDPE, and MDPE, and further, including a single-layers and multilayers) fabricated by the inflation method and having a thickness of from 60 μm to 140 μm. As a result, the film is comparatively soft, has excellent weldability, and can both suppress the occurrence of pin-holing of unsealed portions and suppress the occurrence of pin-holing during transportation and distribution.

Obtaining a laminated two-ply film for bag packaging in the prior art entailed the provision of two rolls of stock on which the external film and internal film are respectively wound. In the case of the most representative fabrication method of the two-ply bag package, the films that have been drawn from each of the rolls of stock are superposed, and the internal film side and external film side of the superposed films are placed in direct contact. The superposed films are then sealed to each other and formed as film for two-ply bag package.

The method of the prior art required two rolls of stock, and this factor not only complicated the handling of the material, but also raised the concern of confusing the inner layer side and outer layer side. In contrast, the present invention takes as a two-ply film a tubular film that is flattened and then used as two stacked layers, and therefore requires the preparation of only one roll of two-ply film.

Explanation next regards an embodiment of the bag forming, filling, and sealing method using a two-ply film according to the present invention.

Figure 7:
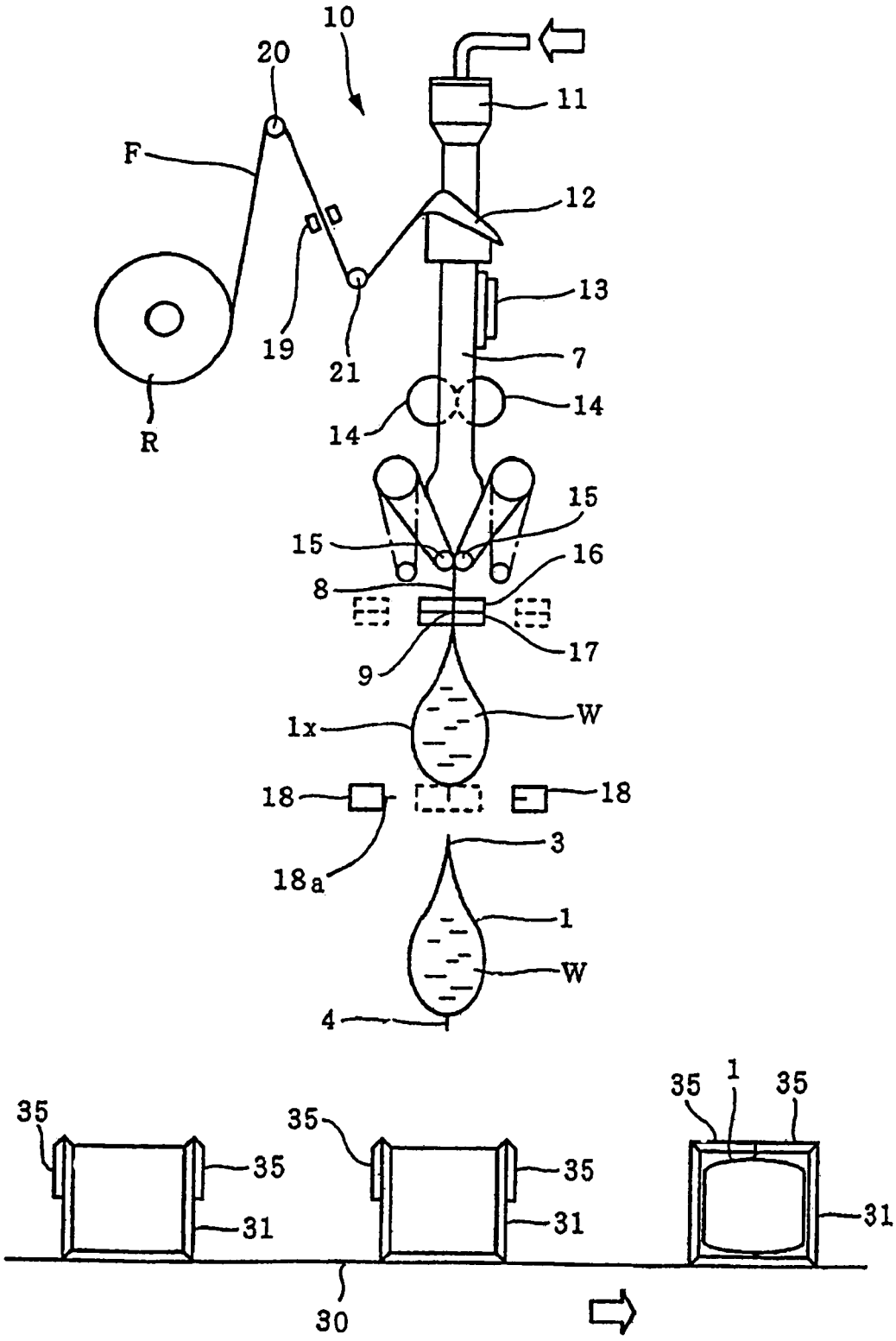
FIG. 7 is an explanatory view showing the steps of the bag forming, filling, and sealing method that employs a two-ply film according to an embodiment of the present invention.

The bag forming, filling, and sealing method of the present embodiment employs pillow-type packaging machine 10 such as shown in FIG. 7 and produces two-ply bag packages 1 that are filled with product W. Two-ply bag package 1 is a bag of two-ply film that is sealed by vertical seal portion 2, lower horizontal seal portion 4 and upper horizontal seal portion 3. Fabricated two-ply bag packages 1 are accommodated inside outer boxes 31.

FIG. 7 shows the completion of paying out two-ply film F during regular operation. Closing squeezing rollers 15 that can be freely opened and closed squeeze the upper opened side of two-ply bag package before cutting 1*x* to form flattened squeezed portion 8. Closing first horizontal sealer 16 and second horizontal sealer 17, which can be freely opened and closed, in this squeezed portion 8 causes the successive formation of horizontal seal portion 9 from the upstream side to the downstream side. Horizontal seal portion 9 includes an upstream welded region, which is lower horizontal seal portion 4, and downstream welded region, which is upper horizontal seal portion 3. Presser/cutter 18 that can be freely opened and closed is opened, whereby two-ply bag package 1 of two-ply film that has been thus fabricated is dropped into outer box 31 having an opened upper surface on conveyor 30.

Following the above-described processes, a prescribed amount of product W is successively introduced from hopper 11 into tube body 7 in which horizontal seal portion 9 that is to be upper horizontal seal portion 3 and lower horizontal seal portion 4 has been formed in the preceding filling step.

After squeezing rollers 15, first horizontal sealer 16, and second horizontal sealer 17 have been opened, feed roller 14 is caused to rotate, whereby tube body 7 and succeeding two-ply film F are paid out a prescribed length together with two-ply bag package before cutting 1*x*.

Two-ply film F is guided to former 12 by way of a plurality of feed rollers 20 and 21. As two-ply film F passes through former 12, it is curved into a tube shape and the two side edges are caused to overlap to form an overlapping portion. As this overlapping portion passes through vertical sealer 13, the overlapping portion is heat-sealed, whereby vertical seal portion 2 is formed that seals the total of four layers of superposed internal films and external films as a single unit. A continuous tube body 7 is thus formed.

When the portion of tube body 7 that has been filled with product has passed through squeezing rollers 15, squeezing rollers 15 are closed, and the upstream side of the product W that has been introduced into tube body 7 is squeezed and flattened to form squeezed portion 8.

First horizontal sealer 16 and second horizontal sealer 17 are closed, and horizontal seal portion 9 is formed at squeezed portion 8, whereby two-ply bag package before cutting 1*x* is produced. In the horizontal sealing step, a total of four layers of internal films and external films are sealed together as a single unit.

Presser/cutter 18 is closed, whereby horizontal seal portion 9, by which two-ply bag package before cutting 1*x* is connected, is cut by cutter 18*a* to form two-ply bag package 1. To state in greater detail, upstream-side welded region, which is lower horizontal seal portion 4 of horizontal seal portion 9, and downstream-side welded region, which is upper horizontal seal portion 3 of horizontal seal portion 9, are pinched and the border of the two regions is cut by cutter 18*a*.

Presser/cutter 18 is opened, and the cut-off two-ply bag package 1 is dropped and accommodated inside outer box 31 that has been placed on conveyor 30 and that has an open upper surface.

The open upper surface of outer box 31, in which two-ply bag package 1 has been accommodated and that is conveyed in the direction of the arrow by conveyor 30, is next closed by lid 35.

Figure 3:
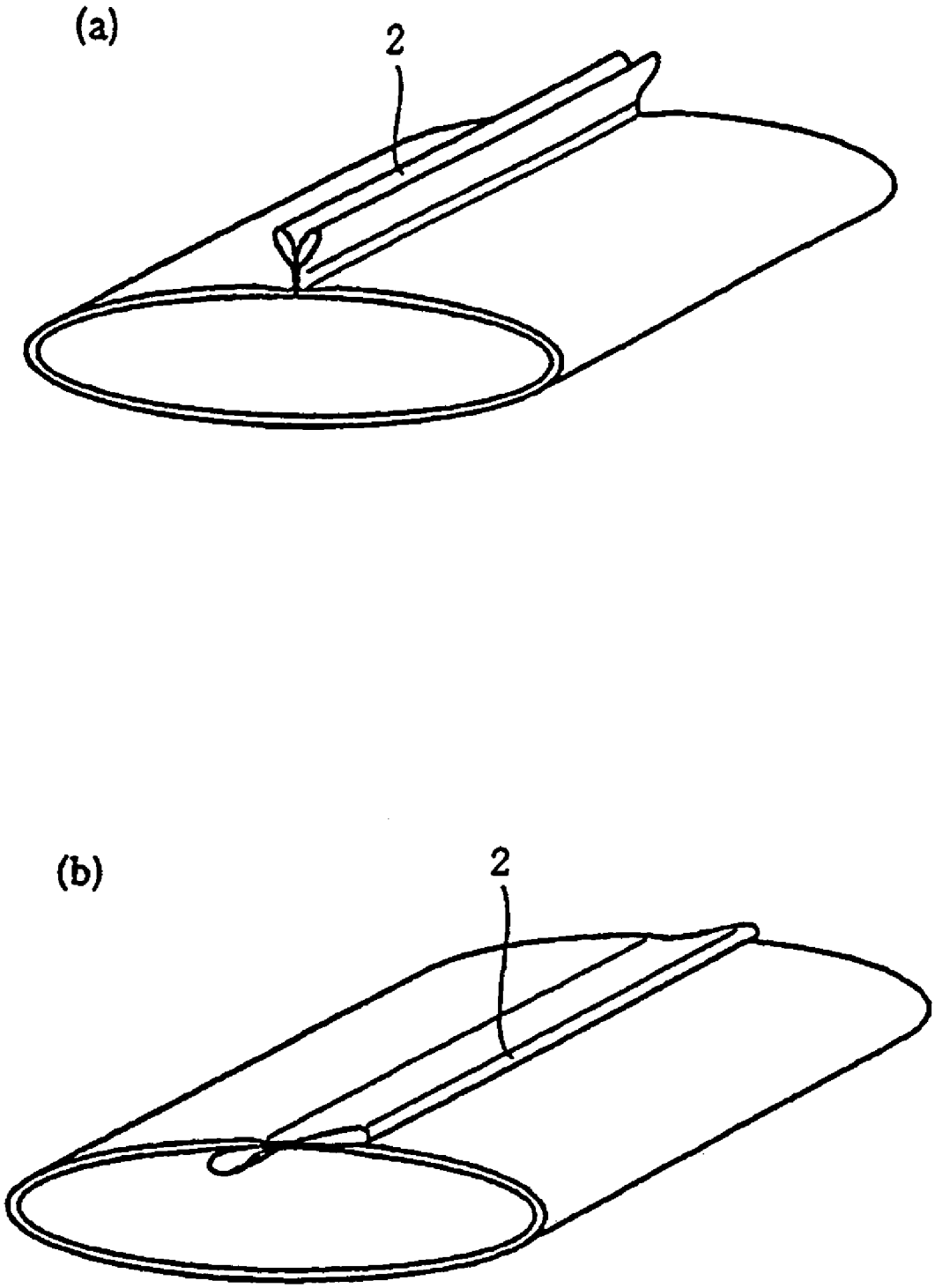
FIG. 3 shows the vertical seal portion of the two-ply bag package, (a) showing a form in which the edge portions are turned toward the outside, and (b) showing a form in which the edge portions overlap with one edge portion turned inside and the other edge portion turned outside.
Figure 4:
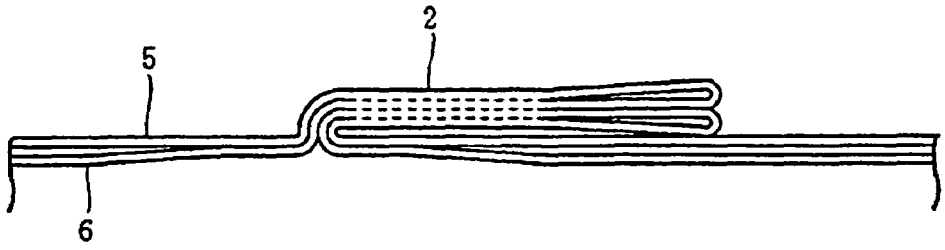
FIG. 4 is a detailed sectional view corresponding to (a) of FIG. 3.
Figure 5:
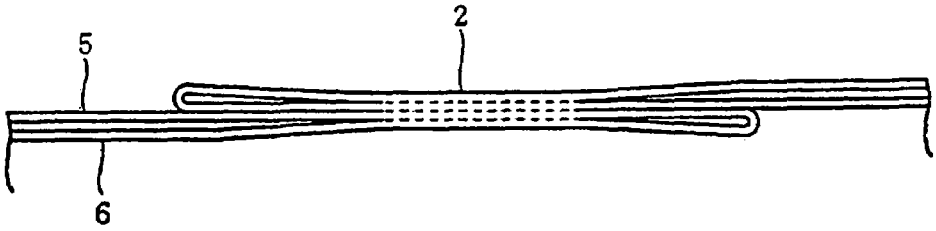
FIG. 5 is a detailed sectional view corresponding to (b) of FIG. 3.

Two-ply bag package 1 is formed by vertical seal portion 2, upper horizontal seal portion 3, and lower horizontal seal portion 4. In addition to the so-called back seal form that is positioned in the center of two-ply bag package 1 as shown in the above-described embodiment, vertical seal portion 2 may also be positioned in one side surface of two-ply bag package 1. The back seal form of vertical seal portion 2 includes one form in which the edges turn toward the outside as shown in (a) of FIG. 3. Alternatively, the edges may be superposed and sealed with one edge turned inside and the other edge turned outside, as shown in (b) of FIG. 3.

Two-ply bag package 1 can be provided with a spout at an appropriate location of the flat portion of the package. Alternatively, in two-ply bag package 1 in which vertical seal portion 2 is positioned in one side surface of two-ply bag package 1, a spout can be provided with the spout clasped and welded within vertical seal portion 2.

Figure 8:
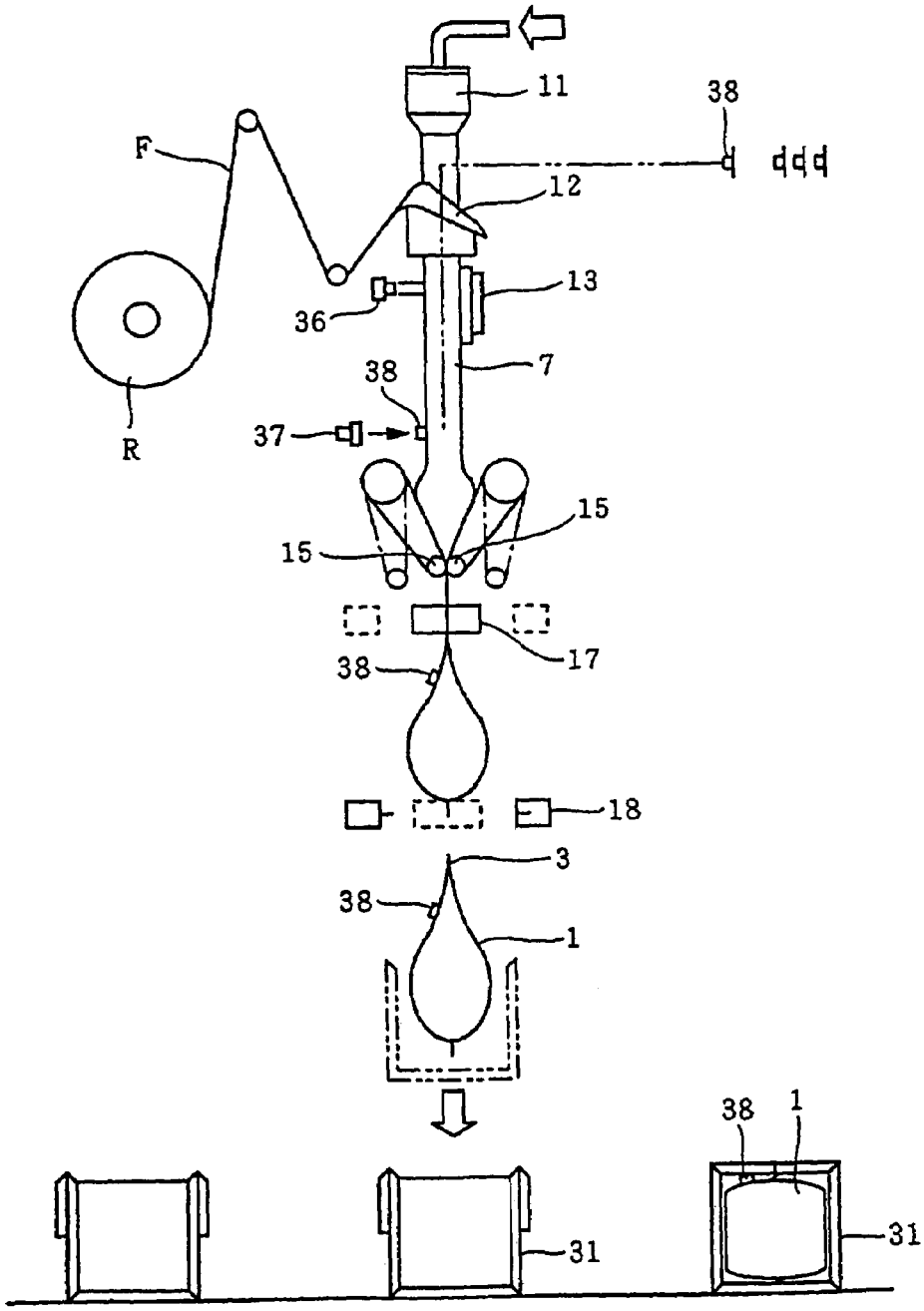
FIG. 8 is an explanatory view showing the steps of the bag forming, filling, and sealing method that employs a two-ply film according to another embodiment of the present invention.

Two-ply bag package 1 in which a spout is provided in a suitable location in the flat portion of two-ply bag package 1 is fabricated by the form that is shown in FIG. 8. For the purpose of installing a spout, the pillow-type packaging machine that is shown in FIG. 8 is provided with: a mechanism for passing spout 38 through the interior of former 12 and arranging the spout inside tubular film; punching mechanism 36 for punching a spout attachment point in the film; and robot structure 37 for welding spout 38 in the hole position of tube body 7 that has been produced by punching mechanism 36. The construction is otherwise similar to pillow-type packaging machine 10 that is shown in FIG. 7.

In the pillow-type packaging machine that is shown in FIG. 8, a hole is punched for installing a spout in tubular body 7 and spout 38 installed to obtain two-ply bag package 1 that is filled with product and provided with spout 38.

Figure 9:
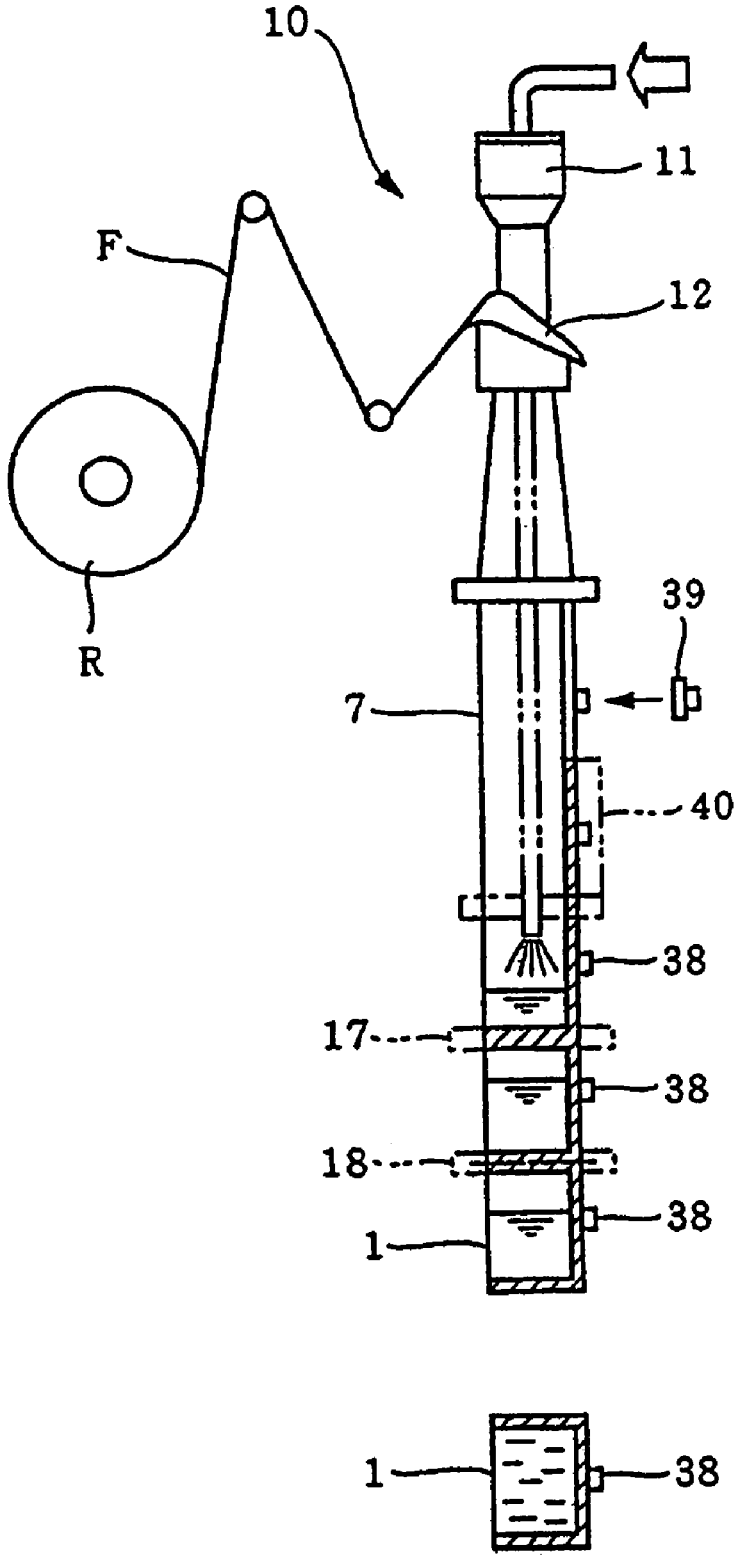
FIG. 9 is an explanatory view showing the steps of the bag forming, filling, and sealing method that employs two-ply film according to yet another embodiment of the present invention.

The form in which spout 38 is welded while clasped in vertical seal portion 2 of two-ply bag package 1 is fabricated in the form shown in FIG. 9. The pillow-type packaging machine that is shown in FIG. 9 is provided with: spout holding robot mechanism 39 for supplying spout 38 to a side surface opening in the film that is formed in approximately tubular form for installing a spout and then welding a vertical seal; and welding mechanism 40 for welding spout 38 in vertical seal portion 2. The construction is otherwise similar to pillow-type packaging machine 10 that is shown in FIG. 7.

In the form that is shown in FIG. 9, two-ply film F is held from both sides by welding mechanism 40 with spout 38 clasped between the two side edges of two-ply film F in which vertical seal portion 2 of tube body 7 is to be formed. These parts are then welded together as a single unit, whereby spout 38 is installed in vertical seal portion 2 of two-ply bag package 1.

As the product that is contained in two-ply bag package 1 that is produced from two-ply film F, foodstuffs in liquid form or viscous form are ideal, examples including flour paste, sweet (bean) paste, chocolate, margarine, liquid eggs, and soft drinks. Alternatively, dry foodstuffs or granular foodstuffs can also be accommodated.

In the present embodiment as described hereinabove, a continuous two-ply film is used in which a tubular film is flattened into a two-ply laminated form in which the two side edges are continuously connected in the longitudinal direction. A bag forming, filling, and sealing method for fabricating two-ply bag packages by using this type of two-ply film and simultaneously forming bags and filling the bags with product by means of a pillow-type packaging machine can reduce the occurrence of defective seals or defective appearance resulting from the occurrence of shifting between the internal film and external film. In addition, the use of a tubular film that has been formed by, for example, inflation forming and then flattened as a two-ply film in which two layers of film are superposed simplifies the process of forming a two-ply film. In addition, because partial seal portions are not formed in the two-ply film that has been obtained in this way, the problems arising when partial seal portions show up in noticeable positions of a package can be suppressed.

While preferred embodiments of the present invention have been described using specific terms, such description is for illustrative purposes only, and it is to be understood that changes and variations may be made without departing from the spirit or scope of the following claims.

What is claimed is:

1. A method of packaging comprising:

providing a tubular inflation film, said film being seamless;

forming a two-ply film having longitudinal side edge portions by flattening the tubular film;

forming a tubular body by curving the two-ply film around a longitudinal axis, wherein the longitudinal side edge portions overlap each other and are sealed together;

sealing an end of the tubular body in a direction generally perpendicular to the longitudinal axis;

filling the tubular body with a product; and sealing a portion of the tubular body above the product in a direction generally perpendicular to the longitudinal axis, thereby forming a product-filled compartment.

2. The method according to claim 1, further comprising separating the product-filled compartment from the remaining tubular body, and repeating the filling step, the sealing step, and the separation step, thereby forming multiple product-filled compartments.

3. The method according to claim 2, further comprising placing each product-filled compartment in another container.

4. The method according to claim 1, wherein the longitudinal side edge portions are placed together in the same direction.

5. The method according to claim 1, wherein the longitudinal side edge portions are placed together in different directions.

6. The method according to claim 1, further comprising punching a hole in the tubular body and installing a spout in the hole before filling the tubular body with the product.

7. The method according to claim 1, further comprising clasping a spout between the longitudinal side edge portions before filling the tubular body with the product.

8. The method according to claim 1, wherein the inflation film has a thickness of 60-150 μn.

9. The method according to claim 1, wherein the product is a liquid food.

10. The method according to claim 1, wherein the tubular film comprises low-density polyethylene.

11. The method according to claim 1, wherein the tubular film is constituted by a laminated film.

12. A bag forming, filling, and sealing method that employs two-ply film is a method in which two-ply film is intermittently paid out for each step of filling with a product and in which a two-ply bag package is fabricated and filled with a product by means of a pillow-type packaging machine; the bag forming, filling, and sealing method comprising the steps of:

(i) providing a tubular inflation film, said film being seamless;

(ii) preparing a two-ply film by flattening a the tubular inflation film such that both side edges are continuously connected in a longitudinal direction;

(iii) curving said two-ply film into a tubular form, and forming a vertical seal portion along a two overlapping side edges to form a continuous tube body;

(iv) forming a horizontal seal portion that intersects with said vertical seal portion;

(v) filling said tube body with a product, said tube body having said horizontal seal portion;

(vi) forming another horizontal seal portion above a position of the product in said tube body;

(vii) dividing the another horizontal seal portion between an upper horizontal seal portion and a lower horizontal seal portion, and then extracting the leading lower two-ply bag package having the lower horizontal seal portion as a top horizontal seal portion; and (viii) repeating step (iii), step (v) wherein the tube body having the upper horizontal seal portion as a bottom horizontal seal portion, step (vi), and step (vii).

13. A bag forming, filling, and sealing method that employs a two-ply film according to claim 12, wherein:

said step of forming said continuous tube body includes a step of punching a hole for installing a spout in said tube body and installing a spout.

14. A bag forming, filling, and sealing method that employs a two-ply film according to claim 12, wherein: said step of curving said two-ply film into tubular form and forming a vertical seal portion in the two overlapping side edges to form a continuous tube body includes a step of clasping a spout between said two side edges.

* * * * *